US008256035B1

(12) United States Patent
Eguchi

(10) Patent No.: US 8,256,035 B1
(45) Date of Patent: Sep. 4, 2012

(54) TOILET SEAT HANDLE

(76) Inventor: Kohei Eguchi, La Canada, CA (US)

( * ) Notice: Subject to any disclaimer, the term of this patent is extended or adjusted under 35 U.S.C. 154(b) by 0 days.

(21) Appl. No.: 13/213,974

(22) Filed: Aug. 19, 2011

(51) Int. Cl.
*A47K 13/10* (2006.01)

(52) U.S. Cl. ..... 4/246.1

(58) Field of Classification Search ..... 4/246.1–246.5
See application file for complete search history.

(56) References Cited

U.S. PATENT DOCUMENTS

| | | | | | |
|---|---|---|---|---|---|
| 752,321 | A | | 2/1904 | Bacon | |
| 1,308,596 | A | | 7/1919 | Klein | |
| 1,506,459 | A | * | 8/1924 | Street | 4/246.4 |
| 2,011,404 | A | * | 8/1935 | Giliasso | 4/246.4 |
| 2,042,276 | A | * | 5/1936 | Revers | 4/246.3 |
| 2,251,770 | A | * | 8/1941 | Warner | 4/246.3 |
| 2,473,082 | A | | 6/1949 | Warner | |
| 3,316,561 | A | * | 5/1967 | Newkirk | 4/246.3 |
| D341,071 | S | | 11/1993 | Prusak | |
| D341,765 | S | | 11/1993 | Thomas | |
| 5,461,733 | A | * | 10/1995 | McKee | 4/246.1 |
| 5,564,135 | A | * | 10/1996 | Jones et al. | 4/300.3 |
| 5,806,106 | A | * | 9/1998 | Carter et al. | 4/246.1 |
| 5,829,067 | A | * | 11/1998 | Smith | 4/246.1 |
| 5,940,896 | A | * | 8/1999 | Berring | 4/241 |
| D441,439 | S | | 5/2001 | Nagel et al. | |
| 6,263,517 | B1 | * | 7/2001 | Brooks | 4/246.1 |
| 6,305,032 | B1 | * | 10/2001 | Jones | 4/246.1 |
| D483,450 | S | * | 12/2003 | Moore | D23/309 |
| 6,922,853 | B2 | * | 8/2005 | Mantell | 4/246.1 |

FOREIGN PATENT DOCUMENTS

JP 2003-299597 A 10/2003

* cited by examiner

*Primary Examiner* — Lori Baker
(74) *Attorney, Agent, or Firm* — DLA Piper LLP (US)

(57) ABSTRACT

A toilet seat handle including a substantially L-shaped handle main body formed with a handle member and a base member having a receiving section, an elongated hook element slidably provided inside the base member of the handle main body and formed at its tip end with a claw, and an adjustment screw screw-engaged with the base end of the hook element. The toilet seat handle is mounted on a toilet seat by sandwiching a part of the seat with the claw of the hook element and the receiving section of the base member with the tightened adjustment screw.

6 Claims, 6 Drawing Sheets

TOILET SEAT HANDLE

BACKGROUND OF THE INVENTION

1. Field of the Invention

The present invention relaters to toilet seat lifting devices and more particularly to a sanitary toilet seat handle that is attached to a toilet seat for allowing a user to raise and lower a toilet seat without directly touching the seat.

2. Description of the Related Art

Toilet seats are mounted on toilet bowls to be raised to the vertical position and lowered to the horizontal resting position, and it is necessary for people who use the toilet to touch the toilet seat directly by their hands to raise and lower the seat. By the nature of use, toilet seats are unsanitary, since it is often soiled or at least have bacteria and germs thereon, and this issue is particularly acute for toilets at public places such as restaurants, parks, theaters, etc. Furthermore, for people who have lower back problems, it is painful or almost impossible to bend over to lift the toilet seat from the toilet bowl.

There have been a number of suggestions on the concern described above, and the most typical solution has been a handle that is attached to a toilet seat whereby the seat can be raised and lowered without fingers and hands of the person using the toilet touching the toilet seat. Some of the toilet seat handles are attached to the toilet seats by adhesives and others are attached by screws; however, generally, they are complex in structure and are not easily attachable and therefore not easy to use.

BRIEF SUMMARY OF THE INVENTION

Accordingly, an object of the present invention is to provide a toilet seat handle that is simple in structure, easy to use or mount and can be manufactured at a low cost.

It is another object of the present invention to provide a toilet seat handle that is highly sanitary in use and can be used for any toilet seat.

The above objects are accomplished by a unique structure for a toilet seat handle of the present invention that includes:

- a substantially L-shaped handle main body including a base member, which is formed with a receiving section and an adjustment hole, and a handle member, which is integral with the base member and extends substantially perpendicular from the base member;
- an elongated hook element slidably provided inside the adjustment hole of the base member and formed at the tip (front) end with a claw and at the rear end with a tapped hole; and
- an adjustment screw screw-engaged with the tapped hole of the hook element.

With this structure, in use, the base member is set at the outer side of a toilet seat, the claw of the hook element is hooked to the inner side of the toilet seat, and then the adjustment screw is turned to be tightened so that the toilet seat is securely held between the claw of the hook element and the receiving section of the base member.

In the toilet handle according to the present invention, the elongated hook element has a polygonal shape in cross-section, preferably rectangular, and the adjustment hole has the same polygonal shape in cross-section, so that the hook element is prevented from rotating about its lengthwise axis line within the adjustment hole when the adjustment screw is turned.

In addition, according to the present invention, an insert(s) can be additionally provided on the hook element and/or the base member so as to further secure and stabilize the toilet seat handle on a toilet seat.

Furthermore, the toilet seat handle of the present invention can be formed of divided two pieces to ensure a lighter overall weight.

DETAILED DESCRIPTION OF THE INVENTION

Figure 1:
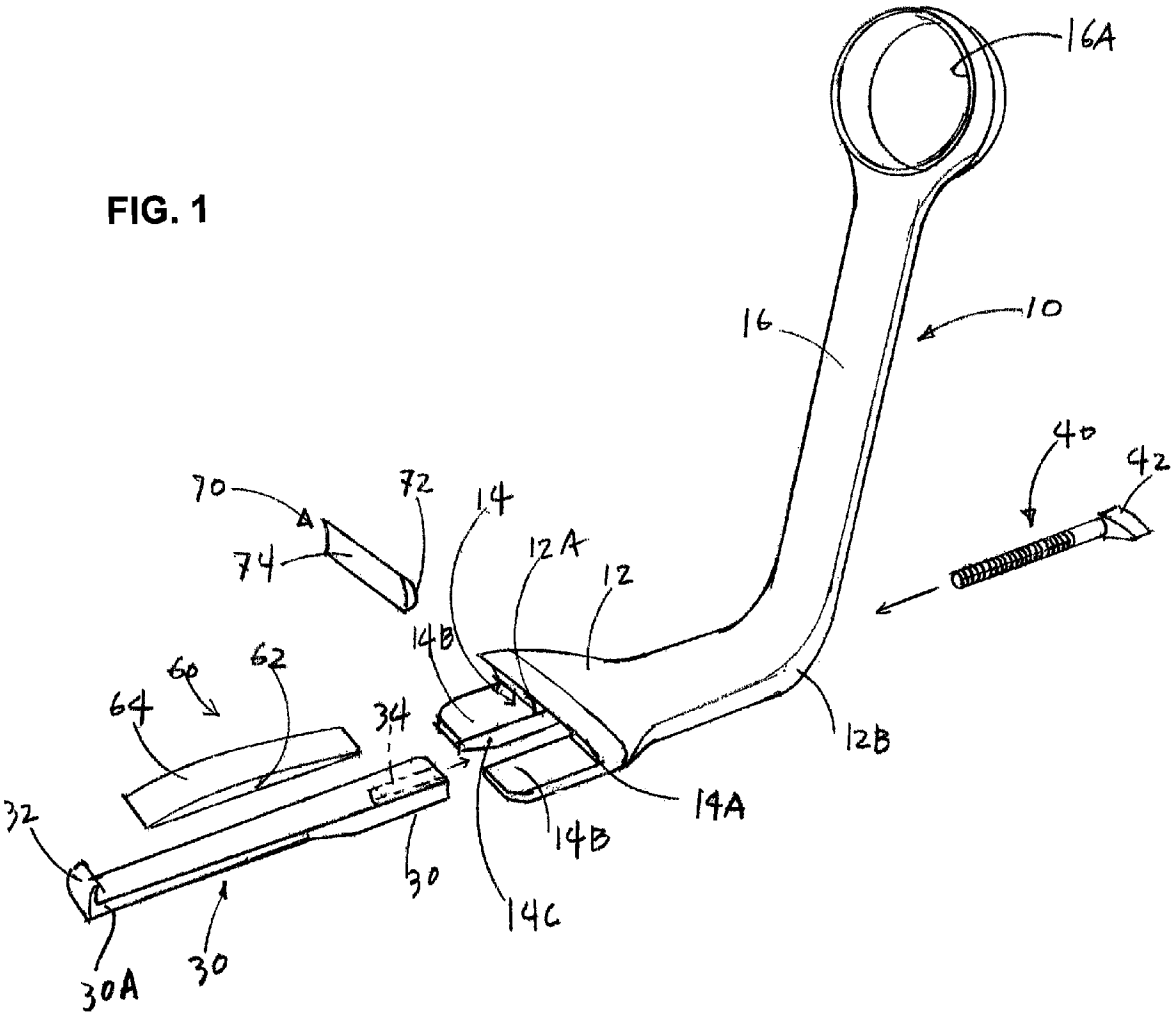
FIG. 1 is a exploded perspective view of a toilet seat handle according to the present invention.
Figure 2:
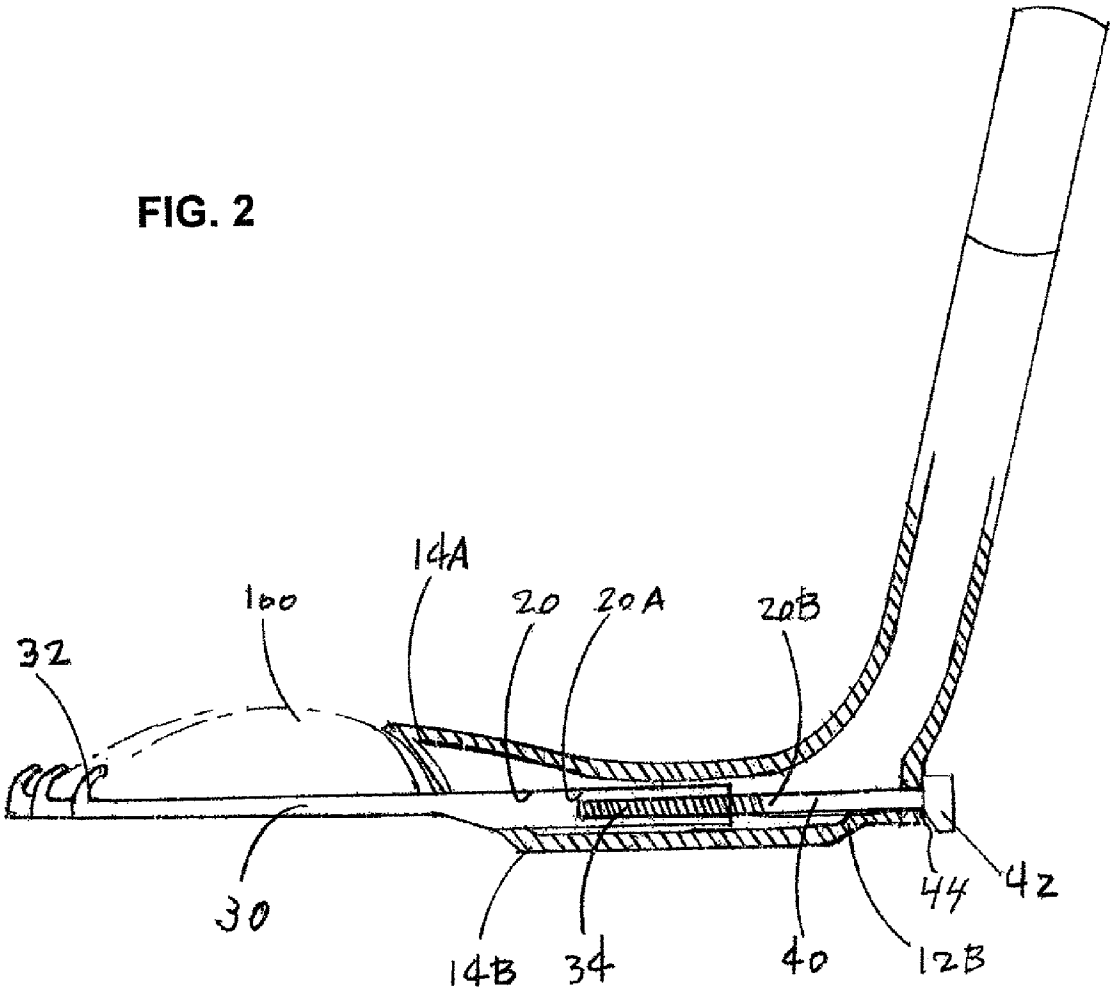
FIG. 2 is a side cross-sectional view thereof.

As seen from FIGS. 1 and 2, the toilet seat handle 1 according to one embodiment of the present invention is comprised of a substantially L-shaped handle main body 10, an elongated hook element 30 slidably provided inside of the short side of the L-shaped handle main body 10, and an adjustment screw 40 that is attached to the hook element 30.

The handle main body 10 is comprised of a base member 12 and a handle member 16 which are integrally made of plastic material such as ABS (acrylonitrile butadiene styrene) resin and therein may be anti-bacterial. It can be made of aluminum for its entirety. As seen from FIG. 6, the handle main body 10 may take a two-piece construction in which the handle main body 10 of FIG. 1 is divided into two pieces lengthwise and comprised of a right and left elements 10A and 10B with a connecting ring 10C in the grip loop 16A. The left and right elements 10A and 10B are formed into one piece handle by securely inserting the connecting bosses 10D of the left piece 10A into the connecting holes (not shown) of the right piece 10B.

Figure 6:
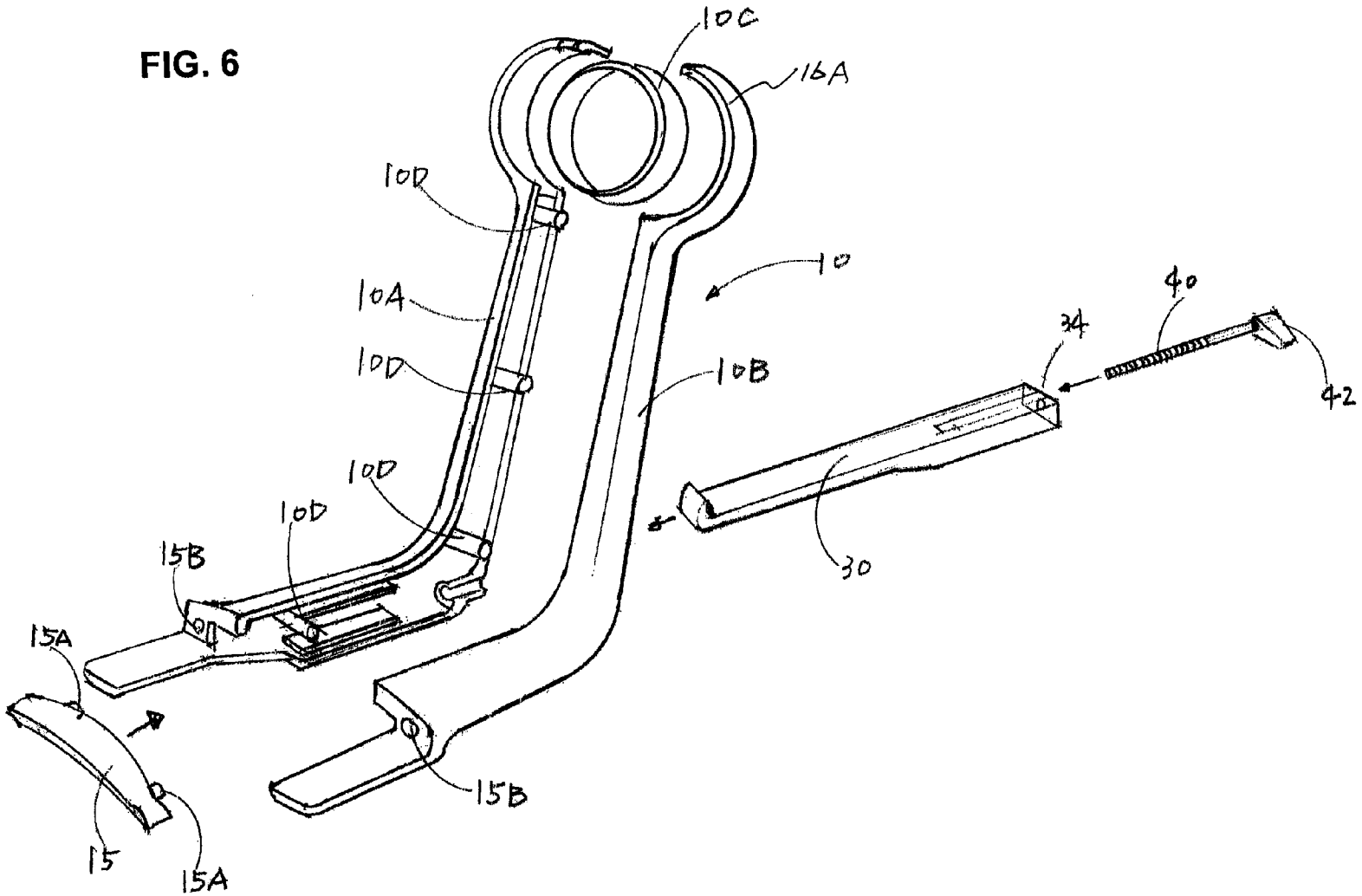
FIG. 6 an embodiment of the toilet seat handle of the present invention in which the handle main body is comprised of two piece elements.

Typically, as seen from FIG. 1, the base member 12 is somewhat a square pyramid set sideways with a convex outer surface and rounded corners, and it is about 1-inch thick at its thickest point which is along the tip (front) end 12A side, about 6-inches long and about 2-inches wide. The thickness of the base member 12 gradually decreases toward the rear end 12B side where the handle member 16 is provided. The base member 12 is, at the tip (front) end 12A, formed with a receiving section 14 that receives therein a part of a toilet seat. The receiving section 14 is comprised of an upper jaw 14A and a lower jaw 14B which is formed with a guide groove 14C at the center. In the structure of FIG. 6, instead of the upper jaw 14A, a jaw element 15 is employed which is attached to the front end of the base member of the handle 10 with the connecting bosses 15A of the jaw element 15 securely inserted into the connecting holes 15B formed in the front end of the base member 12. The upper jaw 14A (or the jaw element 15) is inwardly curved into a concave shape so that it snuggly fits to and mates with the convex curvature of the outer side surface of a typical toilet sheet. The lower jaw 14B is flat so that the bottom of a typical toilet seat can be set thereon. The handle member 16 of the handle main body 10 is about 11-inches long and is formed so as to stand substantially perpendicularly (or in a vertical direction) from the rear end 12B of the base member 12, and it is formed at its tip end with a grip loop 16A of about 2-inch inner diameter. As seen from FIG. 2, the handle member 16 can be inclined for about 100 degrees with respect to the horizontal bottom surface of the base member 12.

The base member 12 is provided with a horizontal adjustment hole 20 so that the elongated hook element 30 is slidably installed therein. The adjustment hole 20 is a through hole provided substantially parallel to the flat bottom of the base member 12, and it is opened (or extends) from one end (tip end 12A) of the base member 12, or from the inside (deep) end of the guide grove 14C, to another end (rear end 12B) of the base member 12, so that it is at the center, when viewed from above, of the base member 12. The adjustment hole 20, as seen from FIG. 2, comprises a sliding section 20A and an adjusting section 20B. The sliding section 20A is formed continuously from the guide grove 14C and is provided so that the hook element 30 is slidable inside in its lengthwise direction. The sliding section 20A has a rectangular cross-section in a perpendicular direction with respect the length of the adjustment hole 20 so that it matches the rectangular cross-section of the hook element 30. The adjusting section 20B of the adjustment hole 20 is formed continuously from the sliding section 20A and communicates with the sliding section 20A. The adjusting section 20B is round so that the adjustment screw 40 is rotatable about its axis within the adjusting section 20B. The guide groove 14C and the adjustment hole 20 comprising the sliding and adjusting sections 20A and 20B are provided on an imaginary single straight line.

The hook element 30, which is about 6-inch long and has a rectangular cross-section in a perpendicular direction with respect to the length, is slidably provided in the base member 12. The hook element 30 is made of, for example, aluminum or plastic, and it is provided at one end (tip end 30A) thereof a claw 32 and at another end (base end 30B) thereof with a tapped hole 34 having an internal thread. The claw 32 is larger in size than the adjustment hole 20 (particularly its sliding section 20A) formed in the base member 12, and it is shaped so as to snuggly fits to and mates with the convex curvature of the inner side surface of a typical toilet sheet. The cross-sectional shape of the hook element 30 and the cross-sectional shape of the sliding section 20A of the adjustment hole 20 of the base member 12 can take any other polygonal cross-sectional shape than the rectangular, including triangle, square and hexagon, so that the hook element 30 is prevented from rotating about its axis line in its lengthwise direction within the sliding section 20A of the adjustment hole 20 when the adjustment screw 40 attached thereto is rotated.

The hook element 30 is set in the guide groove 14C of the lower jaw 14 of the base member 12 and inserted (pushed) into the adjustment hole 20 of the bases member 12 from its base end 30B up to the deep inside end of the sliding section 20A of the adjustment hole 20; and into the tapped hole 34 of the hook element 30, the adjustment screw 40 is screwed. The shank portion of the adjustment screw 40 is formed with an external thread, and head 42 of the adjustment screw 40 is made lager in its outer diameter than the inner diameter of the adjusting section 20B of the adjustment hole 20 so as not to enter into the adjusting section 20B of the adjustment hole 20. With the adjustment screw 40 screwed to the hook element 30, the hook element 30 is, at its base end 30B side, is held in the adjustment hole 20 of the base member 12 and prevented from coming out of the adjustment hole 20 or removed (separated) from the base member 12 (unless the adjustment screw 40 is unscrewed and removed from the hook element 30) thanks to the claw 32 formed at one end and the adjustment screw 40 screwed to another end.

In the above-described structure, the size of the rectangular cross-section of the sliding section 20A in which the hook element 30 is installed is larger than the size of the round cross-section of the adjusting section 20B. The hook element 30 is thus prevented from entering into the adjusting section 20B.

Figure 3:
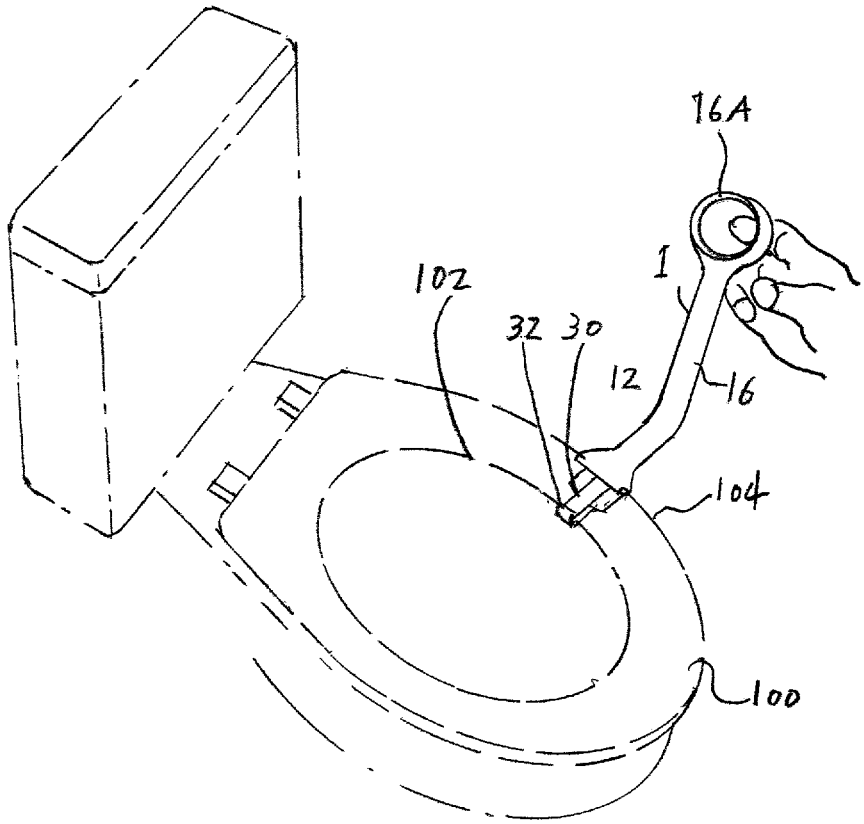
FIG. 3 shows a toilet seat handle according to the present invention mounted on a toilet seat.

With the structure described above, in use, the hook element 30 is extended (pulled) out of the adjustment hole 20 of the base member 12 and set under a toilet seat 100 (see FIG. 4) together with the flat lower jaw 14B of the base member 12, so that the top surfaces of the hook elements 30 and of the lower jaw 14B come into contact with the lower surface of the toilet seat 100. Then, the hook element 30 is pushed into the adjustment hole 20 until the claw 32 comes into contact with the convex curvature of the inner side surface 102 (see FIG. 3) of the toilet seat, and then the adjustment screw 40 is turned to be tightened until the head 42 of the screw 40 comes into tight contact with the rear end surface of the base member 12, more specifically, with the area around the opening of the adjusting section 20B of the adjustment hole 20 of the base member 12. As a result, the toilet seat handle 1 is, as shown in FIG. 3, mounted on the toilet seat 100 by being held (sandwiched) by the claw 32 of the hook element 30 and the receiving section 14 of the base member 12 with the head 42 of the adjustment screw 40 being in a tight contact with the rear end 12B of the base member 12.

A gasket 44 can be put on the (shank near the head 42 of) the adjustment screw 40 for assuring a further tight contact of the screw 40 (head 42 thereof) with the rear end 12B of the base member 12 of the handle main body 10.

Figure 4A:
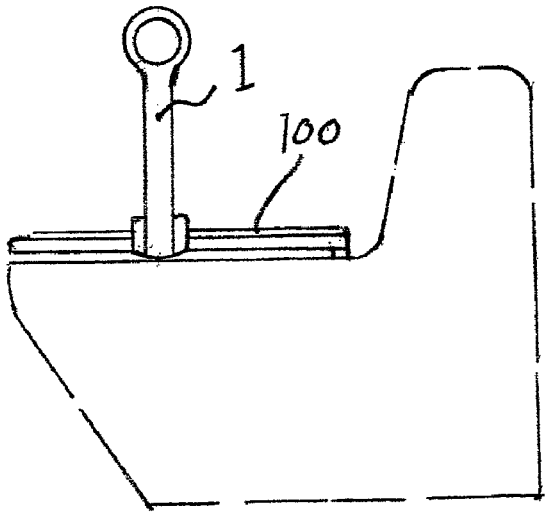
FIGS. 4A and 4B show the lowered and raised positions of a toilet seat handle according to the present invention.
Figure 4B:
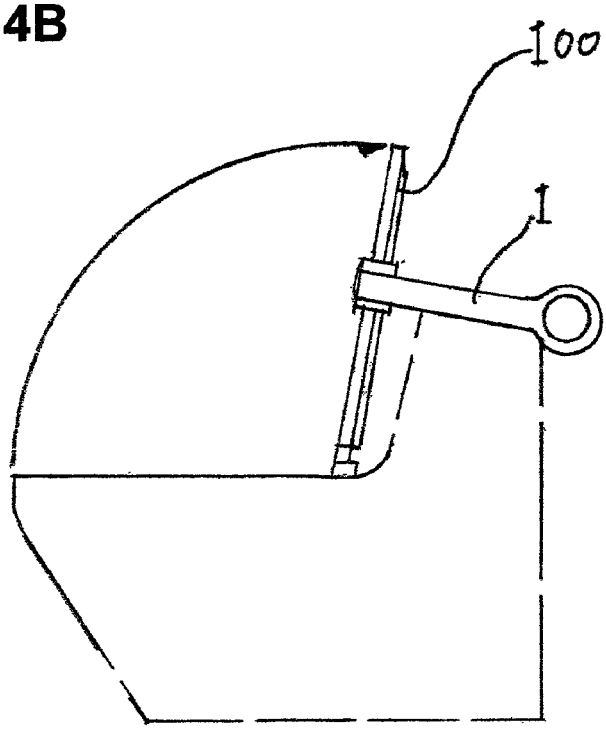

As shown in FIGS. 4A and 4B, with the toilet seat handle 1 mounted on the toilet seat 100, the toilet seat 100 in the lowered position shown in FIG. 4A is, using the toilet seat handle 1, raised to the lifted, vertical position shown in FIG. 4B, and it can be returned, using the toilet seat handle 1, to the lowered, horizontal position shown in FIG. 4B. When thus raising and lowering the toilet seat handle 1, the grip loop 16A at the end of the handle element 16 can be grabbed with finger(s) for easy raising and lowering actions.

As seen from FIG. 1, according to the present invention, an insert (bottom insert) 60 can be attached on the top surface of the hook element 30. The shown insert 60 is an elongated arc shape member when viewed from the side, having arc-shaped side surfaces 62 and a curved (convex) top surface 64, along with a flat bottom. The (bottom) insert 60, made from, for example, elastic material such as silicon, is designed in various shapes and sizes so that its curved (convex) top surface 64 can snugly mate with curved bottom surfaces of various types of toilet seats. With this insert 60 attached on the hook element 30 by, for instance, glue, the bottom of a toilet seat comes into contact with the curve (convex) top surface 64, and thus, the base member 12 having the hook element 30 with the insert 60 attached thereon can fit to any toilet seat that has a concave bottom, and the toilet seat handle 1 is further secured and stabilized on a toilet seat.

Another type of insert (side insert) 70 can be additionally or solely attached to, as seen from FIG. 1, the concave shape upper jaw 14A of the receiving section 14 of the base member 12. The (side) inset 70 is an elongated curved member having arc-shaped ends 72 and a concave outer surface 74, along with a convex inner surface which is the other side of the concave outer surface 74. The insert 70, made from, for instance, elastic material such as silicon, is designed in various shapes and sizes so that its concave outer surface 74 can snugly mate with the convex curvature of the outer side surface 104 (see FIG. 3) of various types of toilet seats. With this (side) inset 70 attached to the receiving section 14 of the base member 12 by, for instance, glue, the base member 12 can fit to various convex curvatures on the outer side surfaces of any toilet seats, and the toilet seat handle 1 can be mounted on a toilet seat in a further secured and stabilized fashion.

Figure 5:
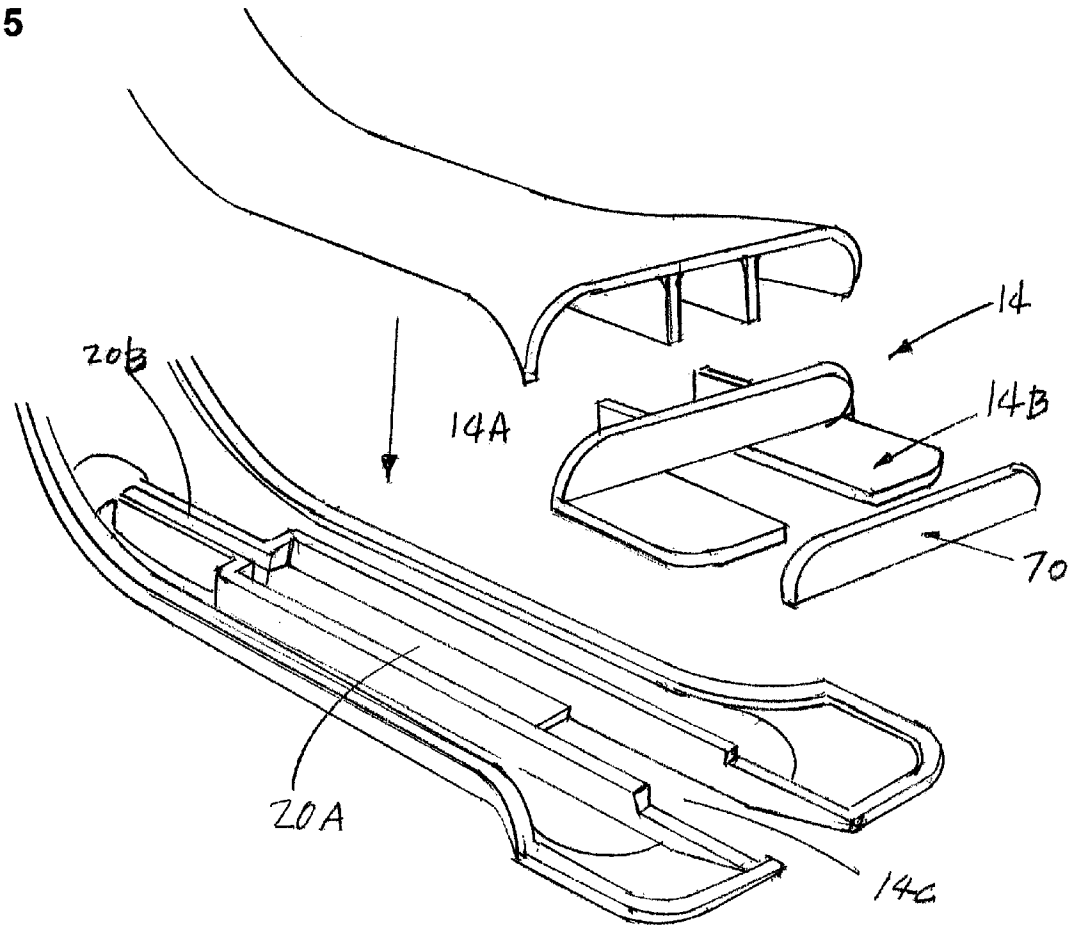
FIG. 5 shows the handle main body of a toilet seat handle according to the present invention formed in divided two pieces.

In the present invention, as seen from FIG. 5, the L-shaped handle main body 10 of the toilet seat handle 1 can be formed in a divided two pieces, upper piece and lower piece which are glued together. With this structure and also with the structure of FIG. 6, the overall weight of the toilet seat handle 1 can be made lighter than a solid handle described above in FIGS. 1 and 2, providing an easier use for, for instance, elderly persons and people with lower back problems.

As seen from the above, the toilet seat handle according to the present invention, which is comprised of a substantially L-shaped handle main body, an elongated hook element slidably provided inside the base member of the handle main body and formed at its tip end with a claw, and an adjustment screw screw-engaged with the base end of the hook element, is simple in structure and thus economical to manufacture. It is also easy to use or easy to mount on and remove from a toilet seat; and it can be easily cleaned after dismounting. The hook element that actually in touch with the toilet seat and toilet bowl can be easily cleaned after being separated from the adjusting screw and removed from the base member. Since the hook element is typically made of aluminum, cleaning is easy. The toilet seat handle of the present invention can be attached to any (size of) toilet seat due to the hook element that is adjustable in its extended length, and the seat handle can be used under sanitary conditions due to the elongated handle member with a grip loop that is distant from the toilet seat. Furthermore, since the toilet seat is lowered by holding the handle member with hand, sudden impact of the seat crashing a toilet bowl is prevented, thus avoiding damages to the toilet bowl.

The invention claimed is:

1. A toilet seat handle detachably mountable to a toilet seat, comprising:

a substantially L-shaped handle main body including a base member, which is formed with a receiving section and an adjustment hole, and a handle member, which extends substantially perpendicular from one end of said base member;

an elongated hook element slidably provided inside said adjustment hole of said base member, said hook element being formed at a tip end thereof with a claw and at another end thereof with a tapped hole; and an adjustment screw screw-engaged with said tapped hole in said another end of said hook element; and wherein said elongated hook element has a polygonal shape in cross-section and said adjustment hole has a polygonal shape in cross-section, so that said hook element is prevented from rotating about an lengthwise axis line thereof within said adjustment hole.

2. The toilet seat handle according to claim 1, wherein a tip end surface of said base member is concaved so as to receive a convex curvature of a side surface of said toilet seat.

3. The toilet seat handle according to claim 1, further comprising an insert provided on said hook element.

4. The toilet seat handle according to claim 1, further comprising an insert provided in said receiving section of said base member.

5. The toilet seat handle according to claim 1, wherein said handle main body is formed of divided two pieces.

6. The toilet seat handle according to claim 1, wherein said handle member is provided with a grip loop at a tip end thereof.

* * * * *